US007014058B2

(12) United States Patent
Gledhill

(10) Patent No.: US 7,014,058 B2
(45) Date of Patent: Mar. 21, 2006

(54) SELECTIVELY ADJUSTABLE AND COUPLABLE CONTAINER

(76) Inventor: Dale C. Gledhill, 6 Eaglewood La., Sandy, UT (US) 84092

( * ) Notice: Subject to any disclaimer, the term of this patent is extended or adjusted under 35 U.S.C. 154(b) by 0 days.

(21) Appl. No.: 10/229,197

(22) Filed: Aug. 27, 2002

(65) Prior Publication Data

US 2004/0040960 A1 Mar. 4, 2004

(51) Int. Cl.
*B65D 21/024* (2006.01)

(52) U.S. Cl. ..... 220/8; 220/23.4

(58) Field of Classification Search ..... 220/23.4, 220/8, 23.83, 23.86
See application file for complete search history.

(56) References Cited

U.S. PATENT DOCUMENTS 876,235 A * 1/1908 Quackenboss ..... 47/66.1
4,909,406 A * 3/1990 Wu ..... 220/8
5,139,186 A * 8/1992 Loew et al. ..... 224/42.39
5,271,515 A 12/1993 Berkheimer et al. ..... 220/4.27
5,960,744 A * 10/1999 Rutman ..... 119/473
5,992,665 A * 11/1999 Deeter ..... 220/23.4
6,116,447 A * 9/2000 Daoud ..... 220/4.03

* cited by examiner

*Primary Examiner*—Stephen Castellano
(74) *Attorney, Agent, or Firm*—Workman Nydegger

(57) ABSTRACT

A container is provided which includes a first portion and a second portion. The first portion and second portion are slidably disposed so that the container is selectively adjustable between a retracted position and an extended position. The container may also be selectively coupled with another container. The container has a retention portion and a receiving portion. In one embodiment, the retention portion is a flange and the receiving portion is a ridge, the flange of one container being selectively coupled with the ridge of another container. The container may also have a guide which guides the slidaby coupled first portion and second portion. The container may also have a stop which prevents the first portion from separating from the second portion.

31 Claims, 12 Drawing Sheets

SELECTIVELY ADJUSTABLE AND COUPLABLE CONTAINER

BACKGROUND OF THE INVENTION

1. The Field of the Invention

The present invention relates to containers. More particularly, the present invention relates to selectively adjustable and couplable containers.

2. The Relevant Technology

Almost every home and business has cabinets, dressers, desks, shelves or other similar type of furniture that can be used to hold or store various items. Such items may be cooking utensils and cutlery, articles of clothing, such as stockings, jewelry, and so forth, writing implements, office supplies, and other similar items. Generally, without some type of organizer on the shelf or in the drawer, such items are merely thrown onto the shelf or into the drawer (or some other space) and the user must take the time to rummage through the various items to fine one particular item.

Thus, there is and has been a need for structures to organize shelves, drawers and other storage areas so that the different items can be segregated so that one particular item can be quickly and easily retrieved.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention provides containers which may be selectively adjustable in size while at the same time being capable of being selectively coupled to other containers of various sizes.

Figure 1:
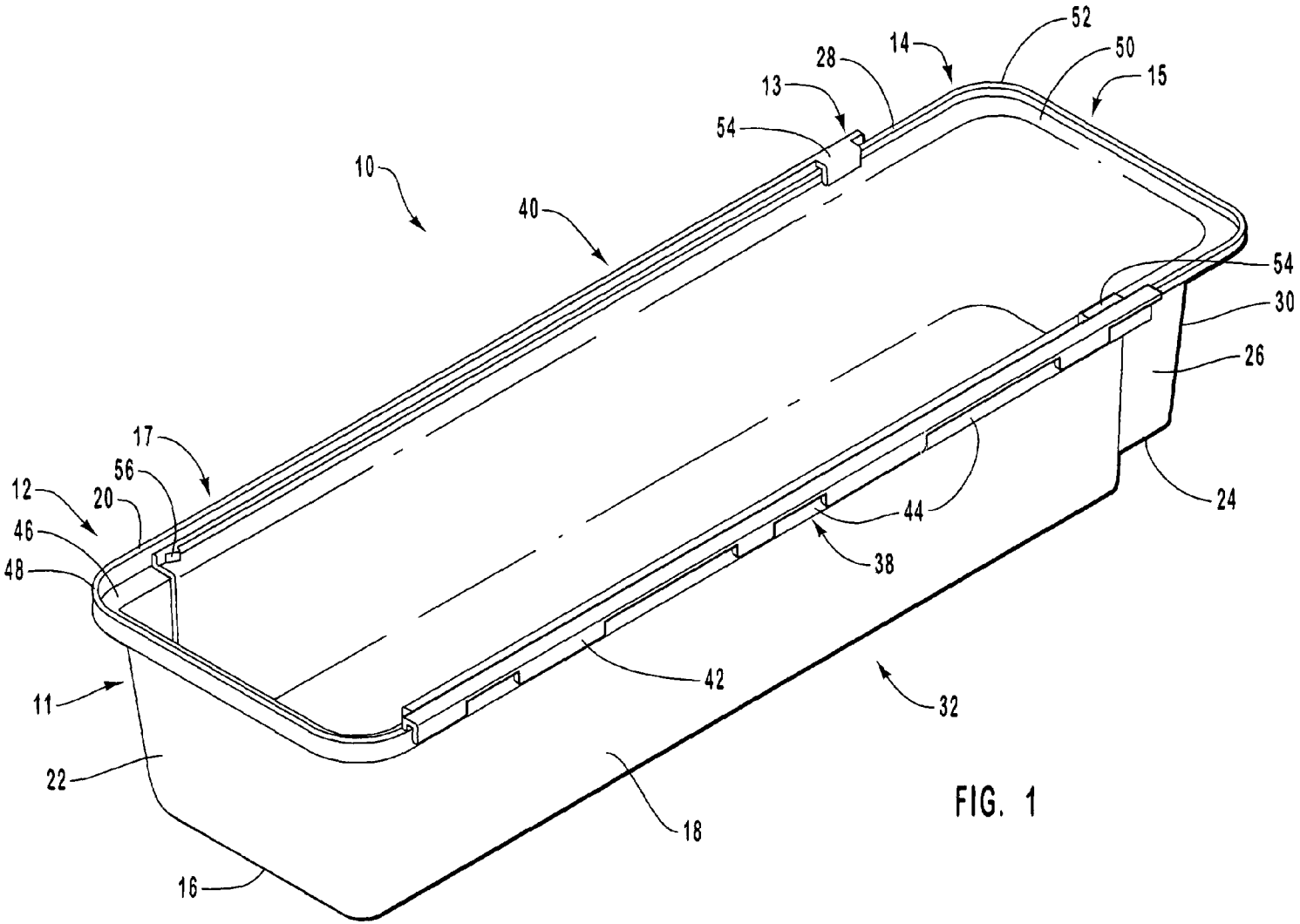
FIG. 1 illustrates a perspective view of a container of the present invention in a retracted position.
Figure 4A:
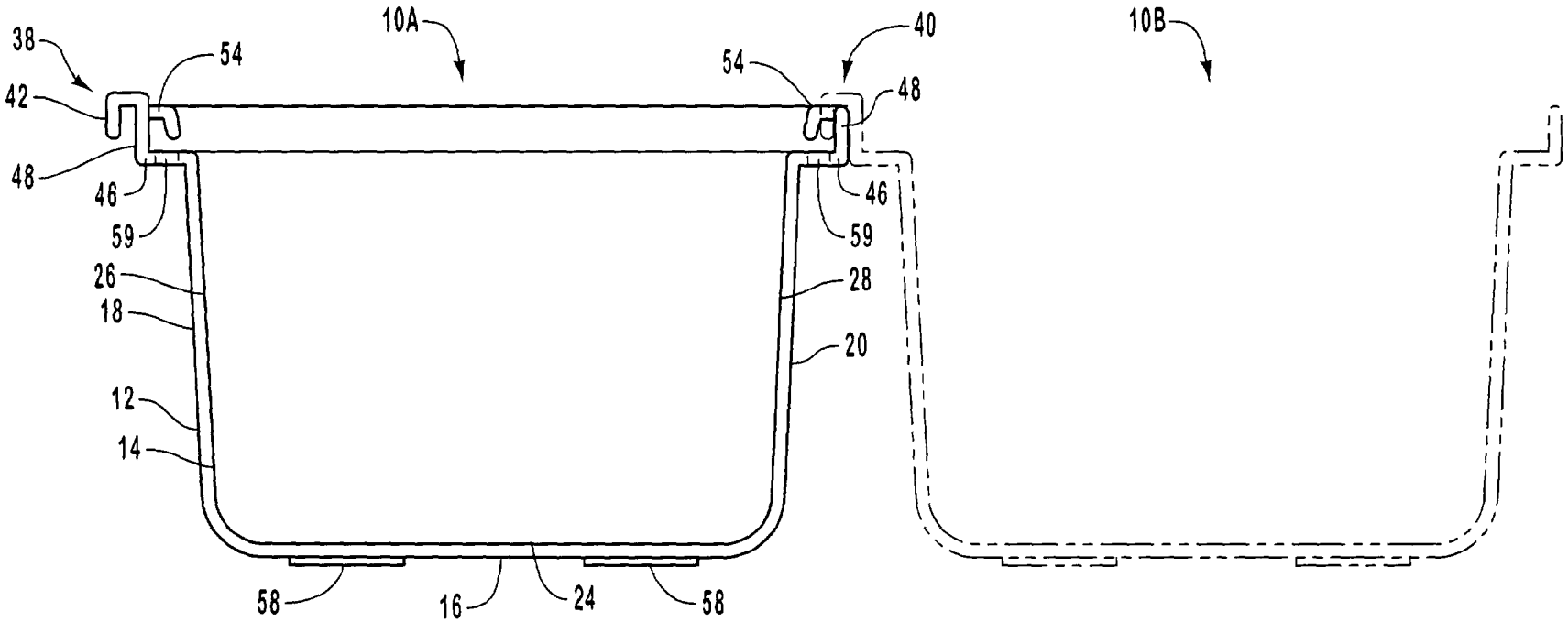
FIG. 4A illustrates a cross-sectional view of the embodiment of the container of FIG. 1.

With reference to FIG. 1, a container 10 in accordance with the present invention is shown. Container 10 comprises a first portion 12 having a first end 11 and a second end 13 and a second portion 14 having a first end 15 and a second end 17. First portion 12 includes a bottom surface 16, first and second sidewalls 18, 20, and an end wall 22. Likewise, second portion 14 includes a bottom surface 24, first and second sidewalls 26, 28, and an end wall 30. As shown in FIG. 4A, sidewalls 18, 20 and bottom surface 16 of first portion 12 and sidewalls 26, 28 and bottom surface 24 of second portion 14 form substantially U-shaped cross-sections. In one embodiment, first portion 12 and second portion 14 are each formed integrally, for example, by injection molding. In this embodiment, it is also appreciated that the corners of first portion 12 and second portion 14 may be rounded. In another embodiment, first portion 12 and second portion 14 may be made from discrete parts glued, welded, or otherwise secured together.

First portion 12 is slidably coupled with second portion 14. In one embodiment, first portion 12 and second portion 14 are slidably disposed such that one of the portions fits inside the other portion. As shown in FIG. 1, second portion 14 fits inside first portion 12 such that first portion 12 and second portion 14 can slide in relation to each other. In another embodiment, first portion 12 may be disposed within second portion 14. In one embodiment, shown in FIG. 1, first portion 12 comprises a ledge 46 disposed around the peripheral edge of sidewalls 18, 20 and end wall 22. First portion 12 also has a ridge 48 formed around and extending upwardly from ledge 46. Similarly, second portion has a ledge 50 disposed around the peripheral edge of sidewalls 26, 28 and endwall 30. A ridge 52 is formed around and extends upwardly from ledge 52. Thus, it will be appreciated that the bottom surfaces, sidewalls, ledges, and ridges of first portion 12 and second portion 14 may be complementarily mated such that first portion 12 and second portion 14 are slidable in relation to each other. The ledges and/or ridges of first portion 12 and second portion 14 may comprise various features which features will be described in more detail below.

Figure 2:
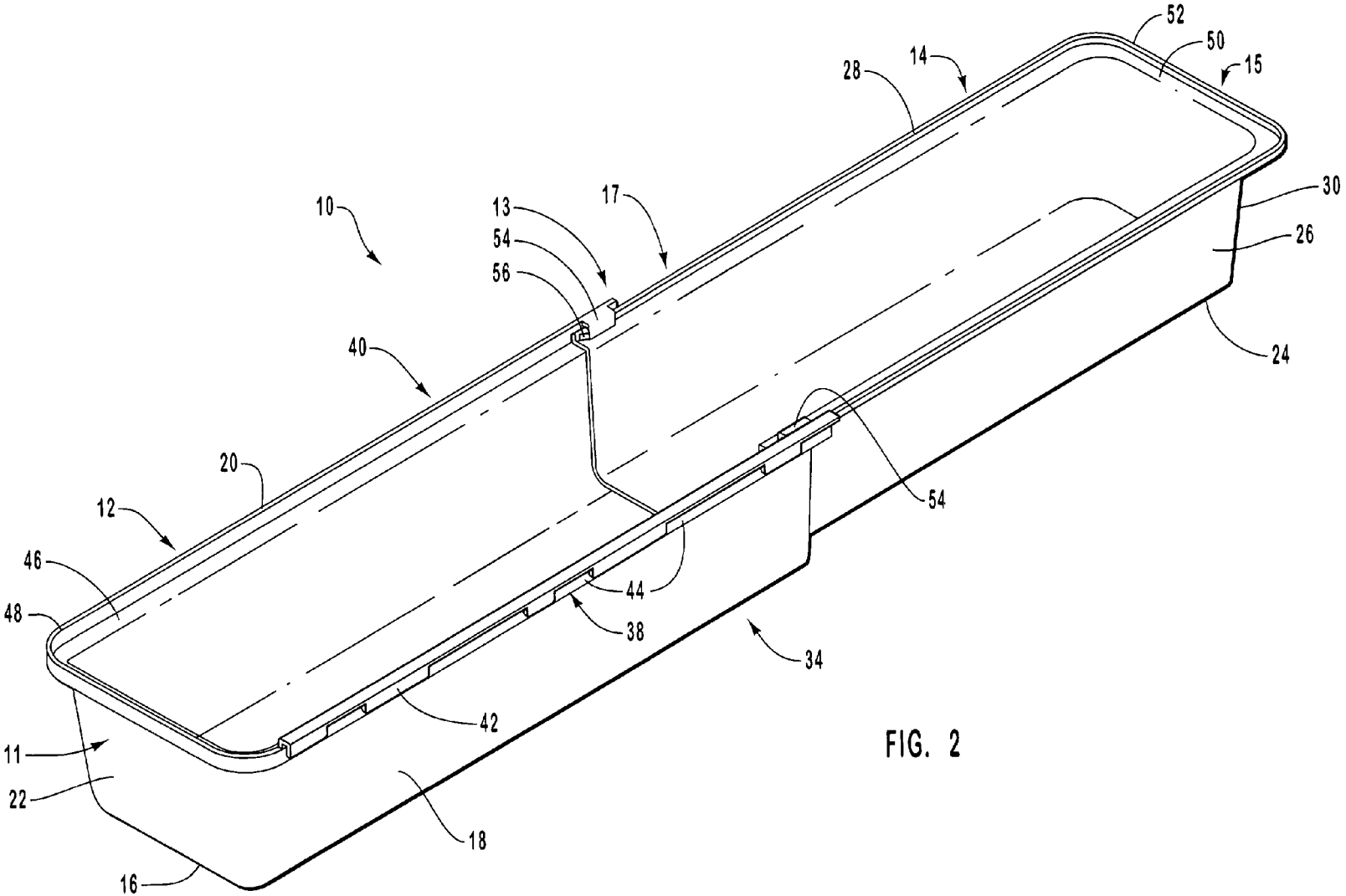
FIG. 2 illustrates a perspective view of the container of FIG. 1 in a fully extended position.

Container 10 is selectively adjustable between a retracted position 32 and an extended position 34. FIG. 1 shows container 10 in the retracted position 32 while FIG. 2 shows container 10 in the extended position 34. It will be appreciated that container 10 is not limited to these two positions, but may be selectively positioned an infinite number of distances between the retracted position 32 and extended position 34. Thus, the present invention allows a user to selectively adjust the size of container 10 so that container 10 can fit in a particular storage area and/or conform to the size of the objects being stored therein.

Container 10 is selectively couplable with other adjustable and/or nonadjustable containers. The present invention provides means for selectively coupling container 10 to another container. As shown in FIG. 1, container 10 has a retention portion 38 and a receiving portion 40. Retention portion 38 is configured to be selectively coupled with the receiving portion 40 of another container. Retention portion 38 is formed on sidewall 18 of first portion 12. Receiving portion 40 is formed on sidewall 20 of first portion 12, opposite the sidewall having the retention portion. It will be appreciated that retention portion 38 may be formed on sidewall 18 of first portion 12, sidewall 26 of second portion 14, or both. Likewise, retention portion 38 may be formed on sidewall 20 of first portion 12, sidewall 28 of second portion 14, or both. The same applies for receiving portion 40. In one embodiment, retention portion 38 and receiving portion 40 are formed longitudinally to the direction of adjustment. That is, as shown best in FIG. 5, container 10A is selectively couplable with another container 10B such that container 10B is adjacent a sidewall 18 or 20 of container 10A.

Figure 3A:
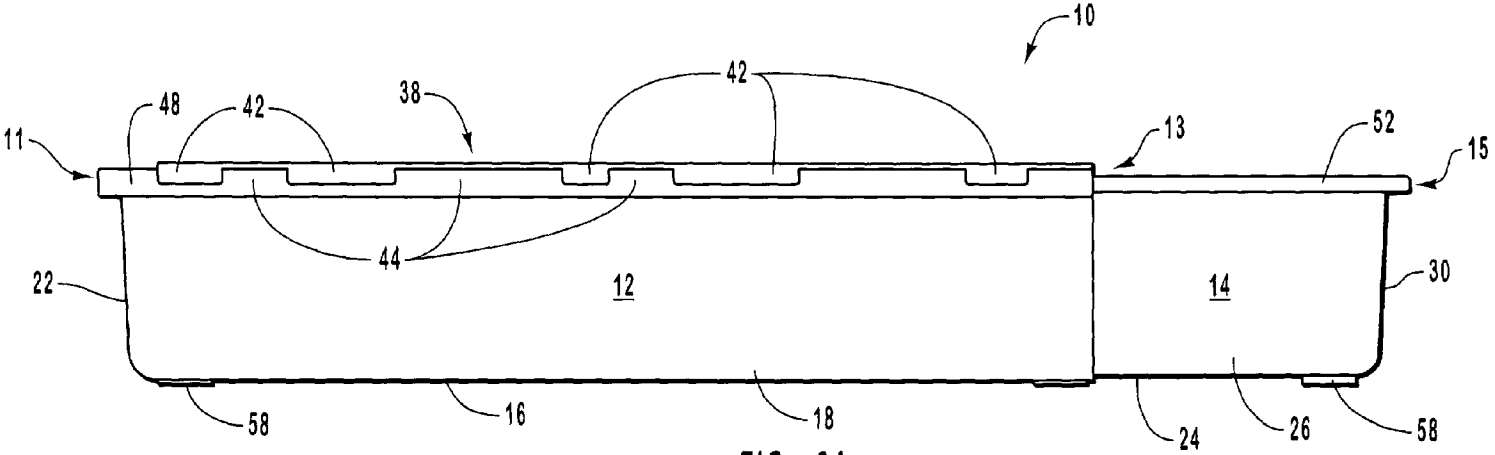
FIG. 3A illustrates a side view of the embodiment of the container of FIG. 1, showing a plurality of feet having varying heights.
Figure 5:
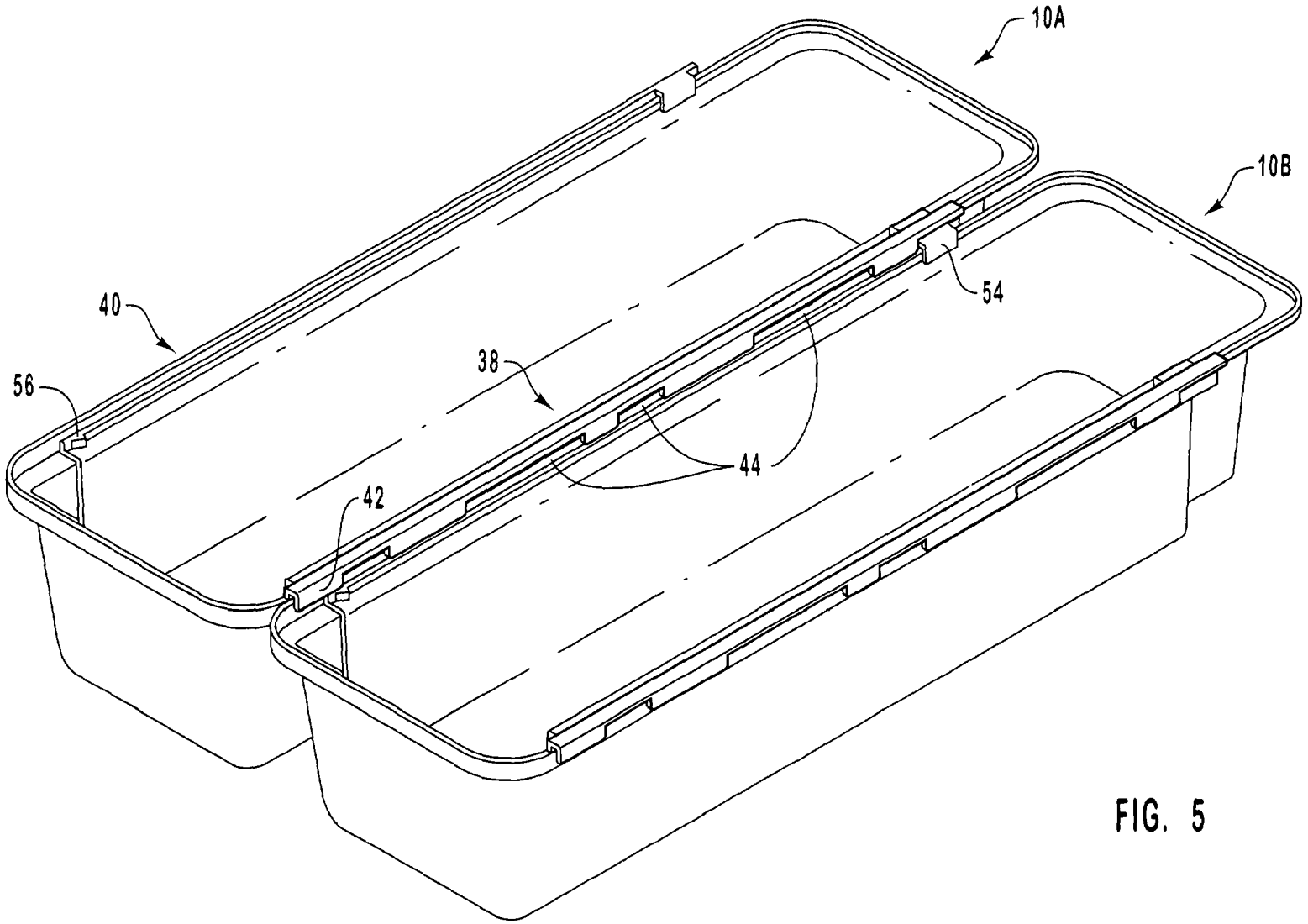
FIG. 5 illustrates a perspective view of two containers of the present invention being selectively coupled together.

In one embodiment, shown in FIGS. 1–3A and 4A, retention portion 38 can be configured in the form of an L-shaped flange 42 extending outwardly from ridge 48 of first portion 12. Receiving portion 40 comprises the portion of ridge 48 formed on the opposite sidewall of first portion 12. Thus, flange 42 acts as a retention arm configured to couple ridge 48. As shown in FIG. 5, flange 42 of a first container 10A is configured to selectively couple with ridge 48 of a second container 10B. Flange 42 may be formed integrally with sidewall 18 of first portion 12, for example, by injection molding. In another embodiment, flange 42 may be mechanically joined to sidewall 18 such as by welding, adhesive, and the like. As shown in FIGS. 3A and 3B, one or more notches 44 may be disposed on a bottom portion of flange 42 at various intervals. In contrast, in FIG. 3C, container 200 has retention portion 38 comprising an L-shaped flange 42 without notches 44. The purpose of notches 44 will be discussed below in more detail.

Figure 6:
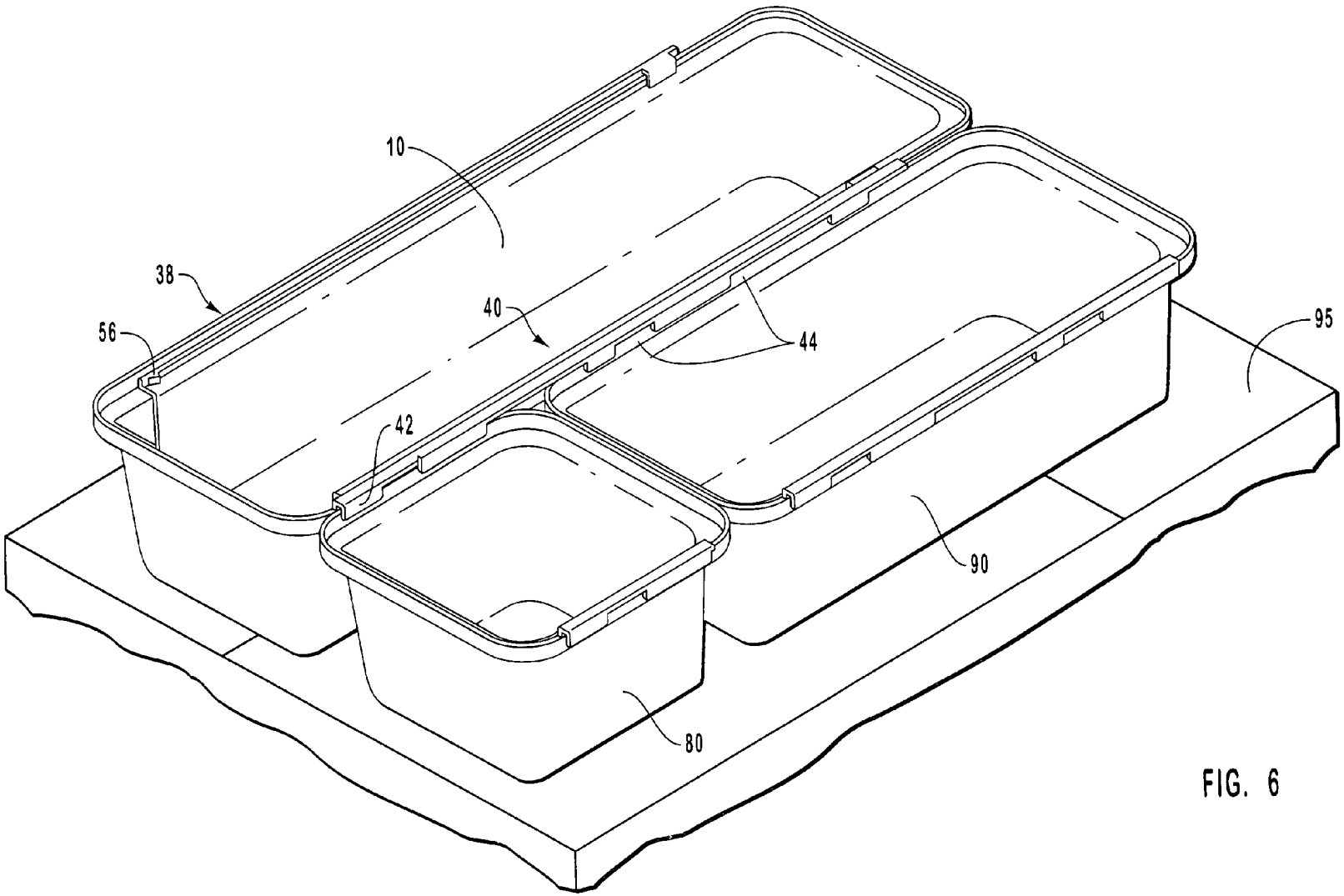
FIG. 6 illustrates a perspective view of a container of the present invention being selectively coupled with two other nonadjustable containers of different sizes.

As shown in FIG. 5, containers 10A, 10B are selectively coupled together. Each container 10A, 10B may be selectively adjusted to a certain length according to the user's desires. Container 10 may also be selectively coupled to one or more nonadjustable containers. For example, FIG. 6 shows container 10 selectively coupled to containers 80 and 90. In one embodiment, containers 10, 80, 90 are adapted to be disposed in a drawer 95. Container 10 is selectively adjustable to match the length of the drawer or a distance smaller than the length of the drawer 95. Containers 80, 90 are nonadjustable and selectively coupled with container 10 to provide other compartments of different sizes. Coupling the containers together prevents the containers from sliding around and becoming disorganized. In addition, combining adjustable containers with nonadjustable containers allows the user to select a storage system specific to the size of the storage space and contents which are to be stored. It will be appreciated that container 10 may be used in conjunction with any number of adjustable and/or non-adjustable containers.

The present invention provides means for guiding first portion 12 and second portion 14 as first portion 12 and second portion 14 slide in relation to each other between retracted position 32 and extended position 34. In the embodiment shown in FIG. 1, bottom surfaces, sidewalls, ledges, and ridges of first portion 12 and second portion 14 may be complementarily mated such that first portion 12 and second portion 14 are slidable in relation to each other. As shown in FIG. 4A, ridge 52 of second portion 14 may be shorter than ridge 48 of first portion 12. An L-shaped guide 54 extends inwardly from sidewall 20 of first portion 12. Guide 54 is configured to be disposed on the top of ridge 52 of second portion 14. As such, guide 54 engages ridge 52. In one embodiment, a pair of guides 54 is disposed on sidewalls 18, 20 (FIG. 4A). In another embodiment, a single guide 54 may be sufficient to guide first portion 12 and second portion 14 (not shown). For example, guide 54 may be disposed on sidewall 18 or sidewall 20.

As discussed above, flange 42 may comprise one or more notches 44. As shown in FIG. 5, when a pair of containers 10A, 10B are coupled together, flange 42 of container 10A couples and rests on ridge 52 of container 10B. Because guide 54 may be located above ridge 52, guide 54 may get in the way of flange 42, preventing container 10A from resting parallel on the surface of the storage area. Notches 44 provide a space to prevent flange 42 from contacting guide 54 on sidewall 20 of first portion 12 so that when containers 10A, 10B are coupled, both rest parallel on the surface of the storage area. It will be appreciated that when a single guide 54 is present on the same sidewall as flange 42, the same problem is not present. Thus, in this situation, flange 42 may or may not have notches 44.

The present invention may also include means for preventing first portion 12 and second portion 14 from separating from each other in the extended position 34. In one embodiment, such means comprises a stop/guide arrangement. As shown in FIG. 1, second end 17 of second portion 14 has a stop 56 formed on ridge 52. Stop 56 engages guide 54 to limit the extended position 34 of container 10. Stop 56 prevents first portion 12 from becoming disengaged from second portion 14. In one embodiment, stop 56 is a knob formed integrally with and protruding inward from ridge 52 on second portion 14. Stop 56 may also be formed by a rubber stop mechanically attached to ridge 52 or ledge 50. It will be appreciated that other configurations for stop 56 may be provided.

Figure 3B:
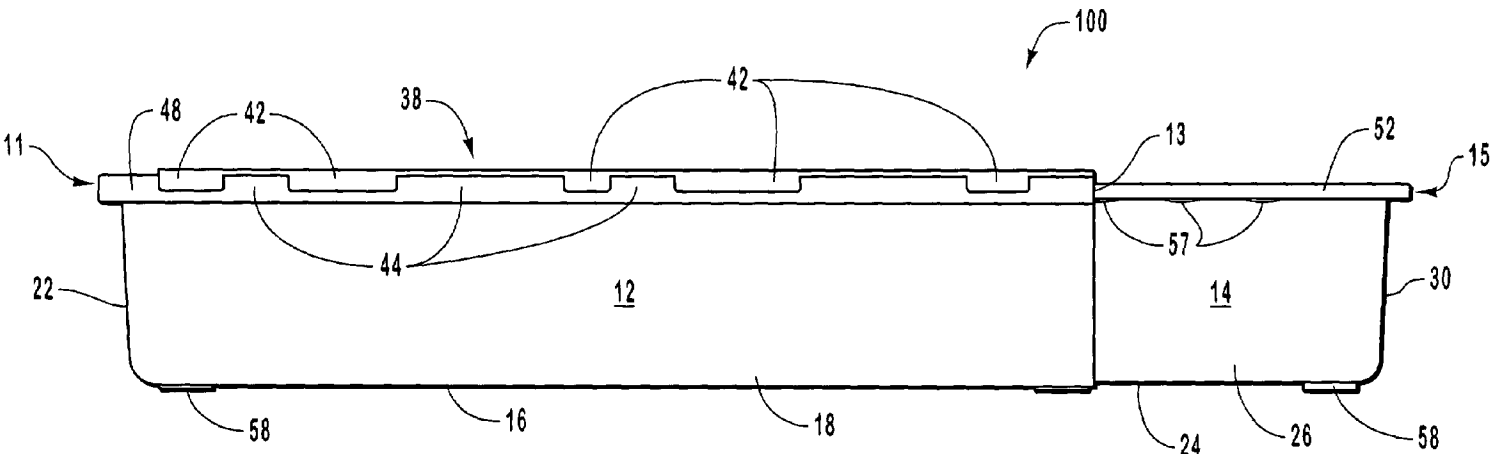
FIG. 3B illustrates a side view of an alternative embodiment of the container of FIG. 1.
Figure 3C:
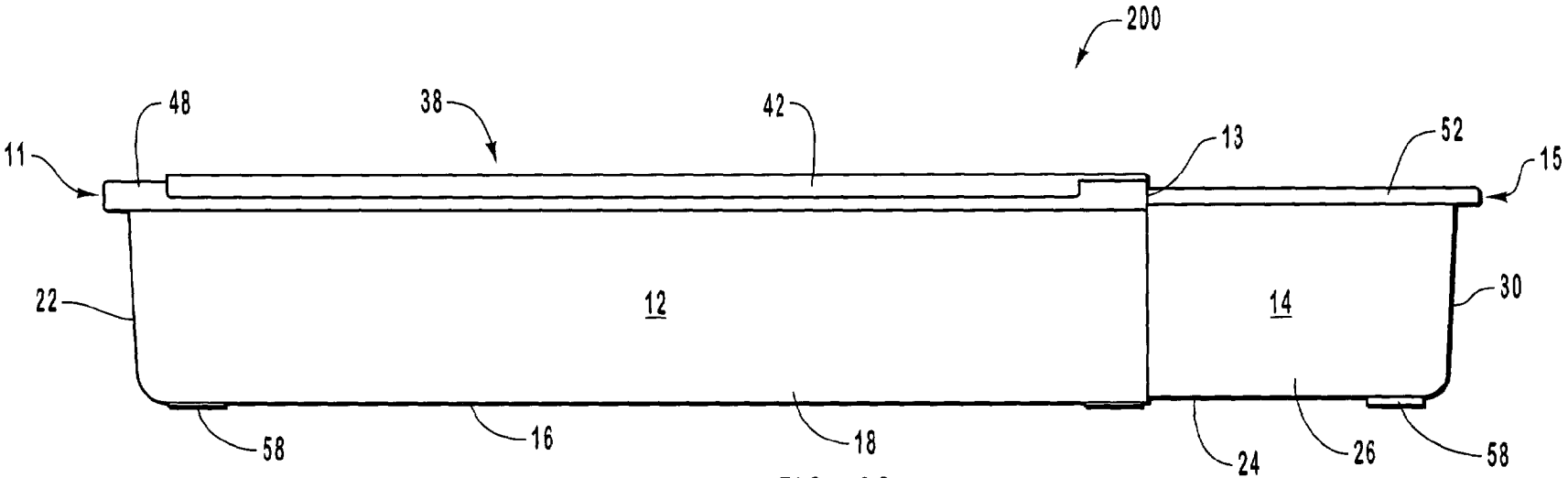
FIG. 3C illustrates a side view of yet another embodiment of the container of FIG. 1.
Figure 4B:
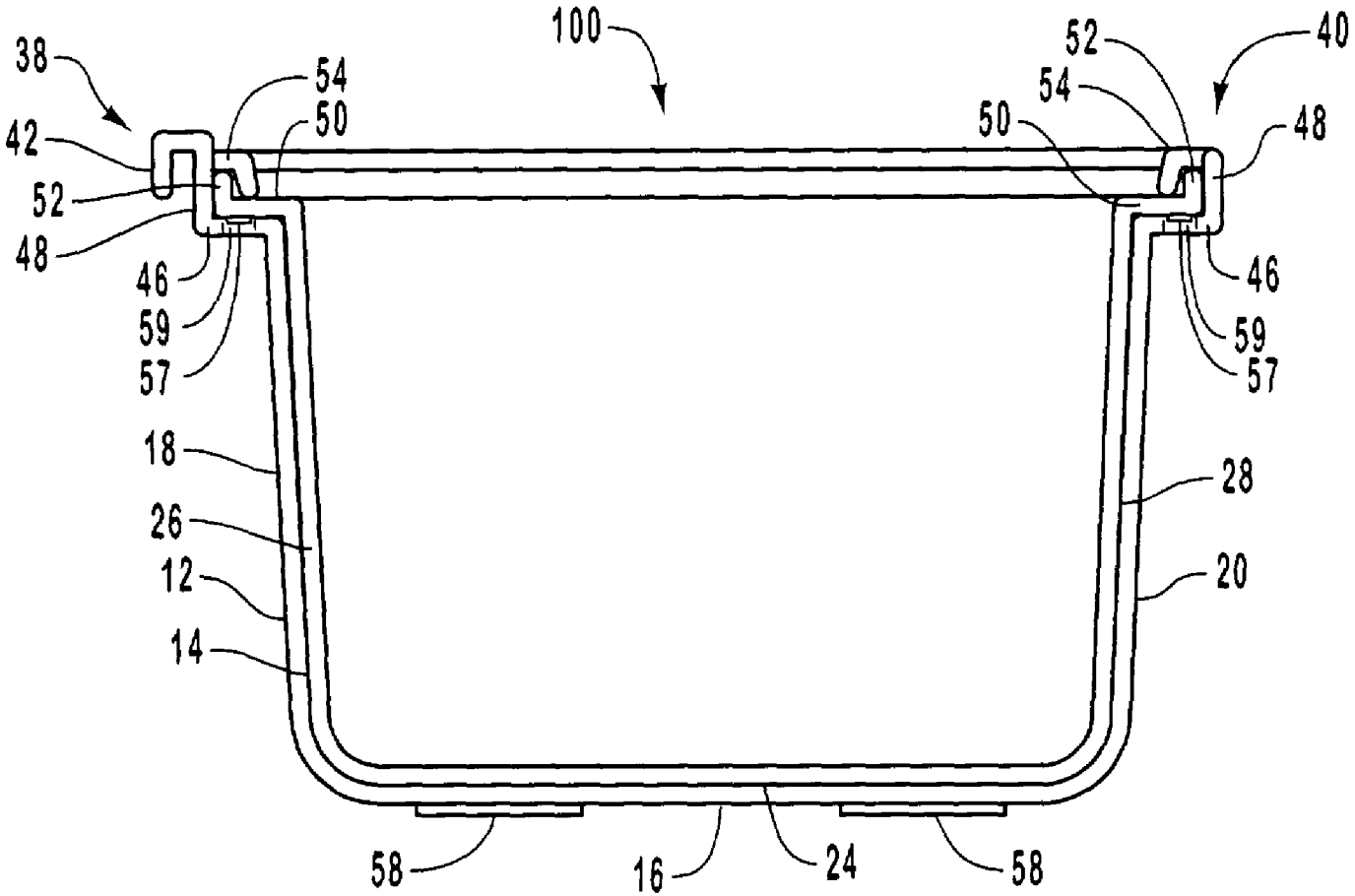
FIG. 4B illustrates a cross-sectional view of another embodiment of the container of FIG. 3B.

In another embodiment, means for preventing first portion 12 and second portion 14 from separating from each other in the extended position 34 may comprise a stop/groove arrangement. As shown in FIGS. 3B and 4B, container 100 comprises much the same elements as container 10 described in FIGS. 1–3A and 4A. Second portion 14 comprises a series of stops 57 disposed on the underside of ledge 50. First portion 12 comprises a groove 59 disposed on the upper surface of ledge 46 underneath guide(s) 54. Stops 57 are configured to be disposed in groove 59 such that when disposed therein, stops 57 and groove 59 prevent first portion 12 and second portion 14 from separating from each other. It will be appreciated that stops 57 and groove 59 do not have to be used in conjunction with guides 54, but may be used with other configurations described herein in order to provide means for preventing first portion 12 and second portion 14 from separating from each other. Stops 57 and groove 59 are configured so that they do not significantly impeded first portion 12 and second portion 14 from being selectively configured between a retracted position 32 and an extended position 34.

It will be appreciated that the foregoing embodiments for means for selectively coupling container 10 to another container, means for guiding first portion 12 and second portion 14, and means for preventing first portion 12 and second portion 14 from separating from each other are presented by way of example and not by limitation. A variety of complementary coupling configurations exist to provide the foregoing means, some of which will be described in the following embodiments.

Figure 7:
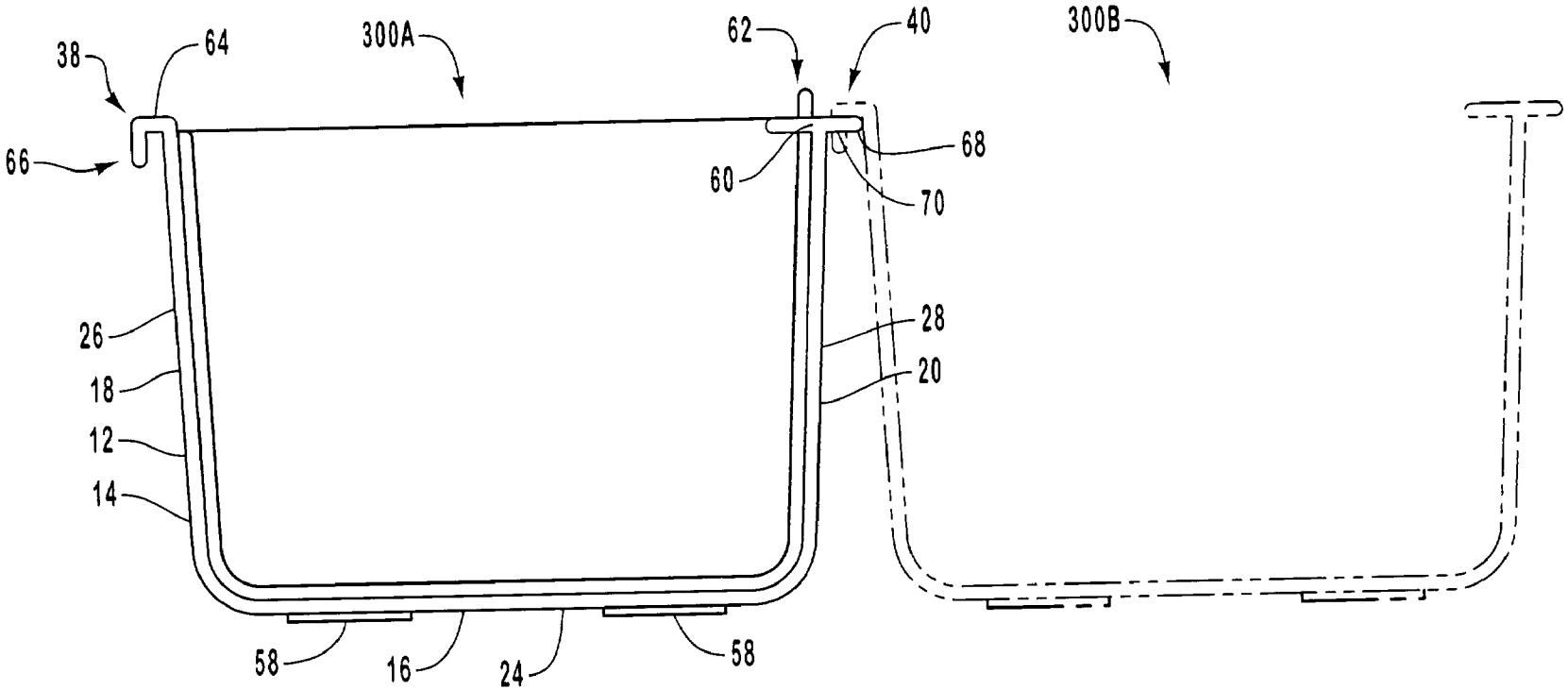
FIG. 7 illustrates a cross-sectional view of another embodiment for the container of the present invention.

FIG. 7 shows another embodiment for means for selectively coupling the container of the present invention to another container. Because the embodiment shown in FIG. 7 is substantially similar to the embodiment shown in FIG. 1, like elements will be referred to with like reference numbers. FIG. 7 depicts container 300A wherein notably ledges 48, 50 and ridges 46, 52 are absent. Instead, first portion 12 and second portion 14 comprise substantially U-shaped portions wherein the sidewalls and bottom surfaces of each portion are complementarily mated to form a sliding surface.

Container 300A comprises a retention portion 38 and receiving portion 40. Retention portion 38 comprises a flange 64 extending outwardly from sidewall 18 of first portion 12. Flange 64 comprises a plurality of pins 66 extending downwardly therefrom. In one embodiment, pins 66 may be spaced apart about every 1 inch or about every 1½ inch. Receiving portion 40 comprises a flange 68 extending outwardly from sidewall 20 of first portion 12. Flange 68 comprises a plurality of holes 80 which correspond in placement to pins 66. Thus, as shown in FIG. 7, container 300A may be selectively coupled to container 300B. That is, pins 66 of container 300A are configured to selectively couple with holes 80 of container 300B.

FIG. 7 also depicts another embodiment for means for guiding the first portion 12 and second portion 14. The means for guiding first portion 12 and second portion 14 comprises a pair of straight guides 60 extending inwardly from sidewall 18 and sidewall 20 of first portion 12. Guides 60 are configured to be disposed on the top of sidewall 26 and sidewall 28 of second portion 14. As such, guides 60 engage sidewall 26 and sidewall 28. It will be appreciated that container 300 may have a single guide 60 disposed on one of sidewall 18 or sidewall 20.

FIG. 7 further depicts another embodiment for means for preventing the first portion 12 and second portion 14 from separating from each other as the first portion 12 and second portion 14 slide in relation to each other between the retracted position 32 and the extended position 34. Second end 17 of second portion 14 comprises a stop 62 which provides means for preventing first portion 12 from separating from second portion 14. Stop 62 comprises a knob extending upwardly from sidewall 26 and/or sidewall 28 at second end 17 of second portion 14. Stop 62 engages guide 60 when first portion 12 and second portion 14 are in the extended position 34. Stop 62 thus provides limits for the extended position of container 10. As shown in FIG. 1, flange 42 may comprise notches 44 to accommodate guide 60 on sidewall 20 of first portion 12.

Figure 8:
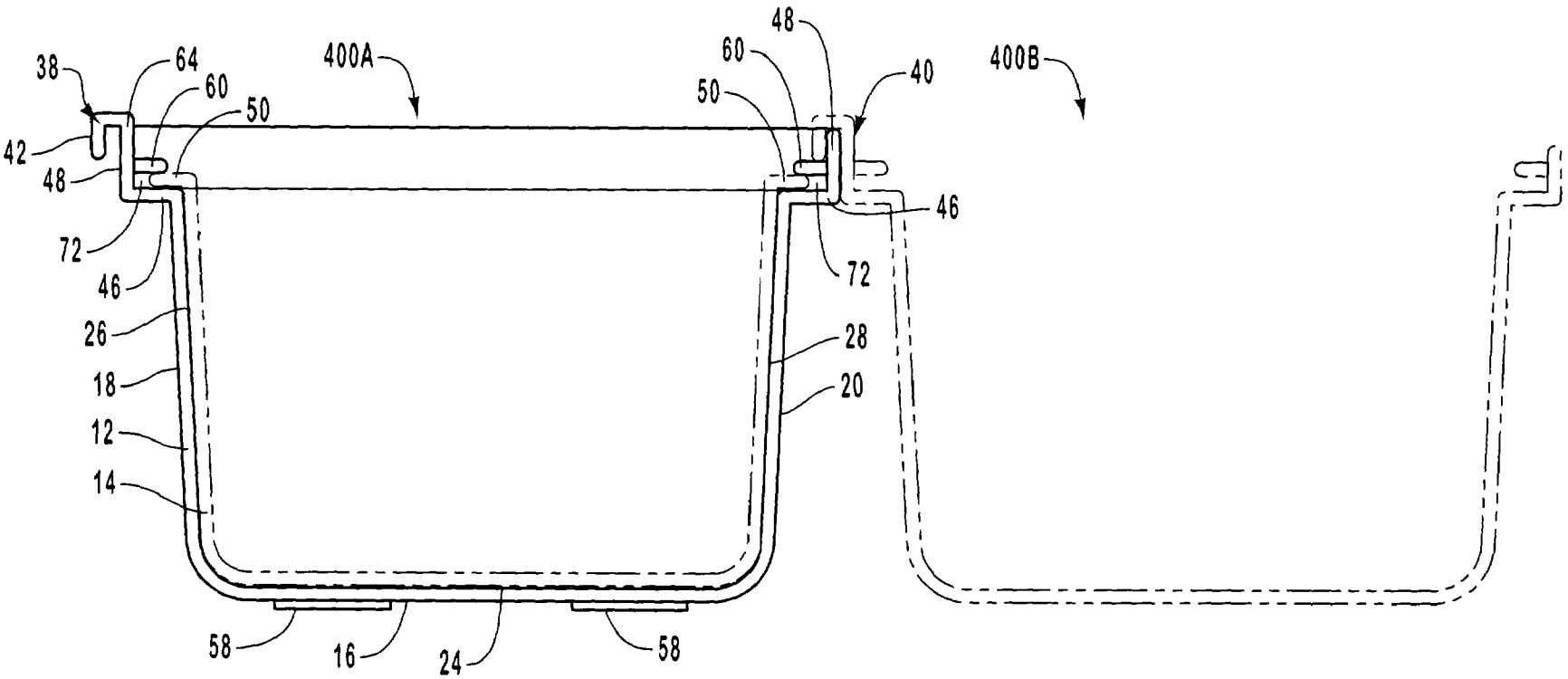
FIG. 8 illustrates a cross-sectional view of yet another embodiment of the container of the present invention.

FIG. 8 also depicts another embodiment for means for guiding the first portion 12 and second portion 14. Container 400A comprises a pair of recesses 72 formed in sidewalls 18, 20 of first portion 12. Second portion 14 comprises a ledge 50 disposed around the peripheral edge of sidewalls 26, 28 and endwall 30. Ledge 50 of second portion 14 is configured to be disposed in recesses 72 of first portion 12. As such, recesses 72 provides means for guiding the first portion 12 and second portion 14. It will be appreciated that a single recess 72 may be disposed on one of sidewalls 18 or 20.

The embodiment shown in FIG. 8 also provides means for preventing first portion 12 and second portion 14 from separating from each other in the fully extended position 34. Second end 17 of ledge 50 comprises a knob or stop (not shown) extending outwardly therefrom. The knob may be formed integrally with ledge 50 such that it extends slightly outward therefrom. Alternatively, the knob may be mechanically attached to ledge 50. Recess 72 is configured to be deep enough to accommodate the composite width of ledge 50 and the knob. Recess 72 at second end 13 of first portion 12 comprises a wall (not shown) disposed transversely to recess 72. The wall extends inwardly from the outer edge of recess 72. Thus, the wall partially covers the end of recess 72. The length of the wall corresponds to the width of the knob. As such, the knob engages the wall to prevent first portion 12 and second portion 14 from separating from each other.

From the foregoing descriptions, it will be appreciated that a variety of configurations may be implemented to form means for selectively coupling container 10 to another container, means for guiding first portion 12 and second portion 14, and means for preventing first portion 12 and second portion 14 from separating from each other and that the foregoing illustrations are presented by way of example and not by limitation.

As shown in FIG. 3A, a plurality of feet 58 may depend from bottom surfaces 16, 24 of first portion 12 and second portion 14. In one embodiment, feet 58 on first portion 12 are slightly shorter in height than feet 58 on second portion 14. This would be so where the second portion 14 is disposed within first portion 12 (FIGS. 1 and 4). Of course, if first portion 12 were disposed within second portion 14, feet 58 on first portion 12 would be slightly greater in height than feet 58 on second portion 14 (not shown). Different heights in feet 58 on the first portion 12 and second portion 14 provide that container 10 is substantially level to the surface upon which it rests. Feet 58 may be padded or textured to prevent container 10 from sliding.

Figure 9:
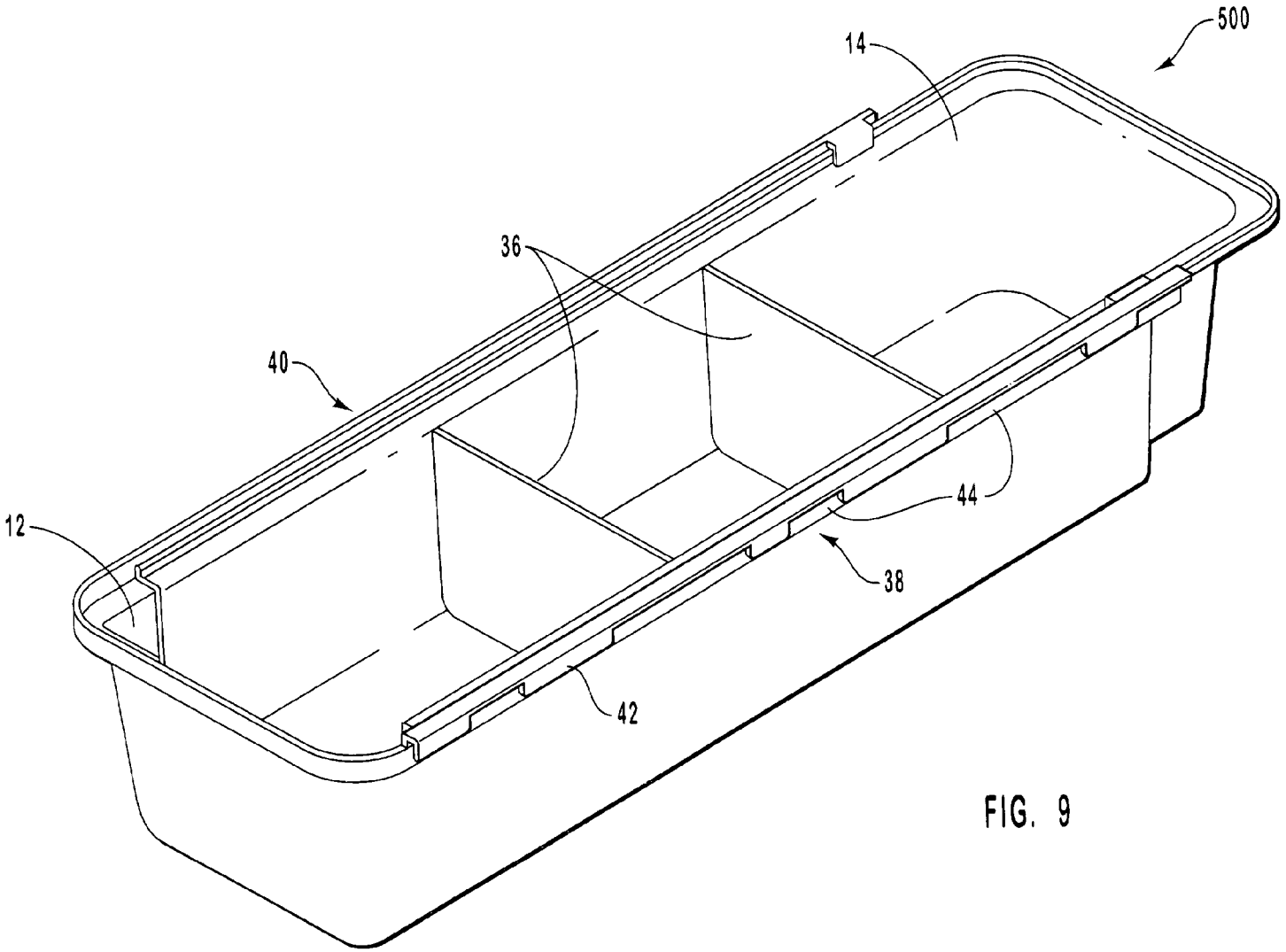
FIG. 9 illustrates a perspective view of yet another embodiment of the container of the present invention depicting the container having more than one compartment.
Figure 10:
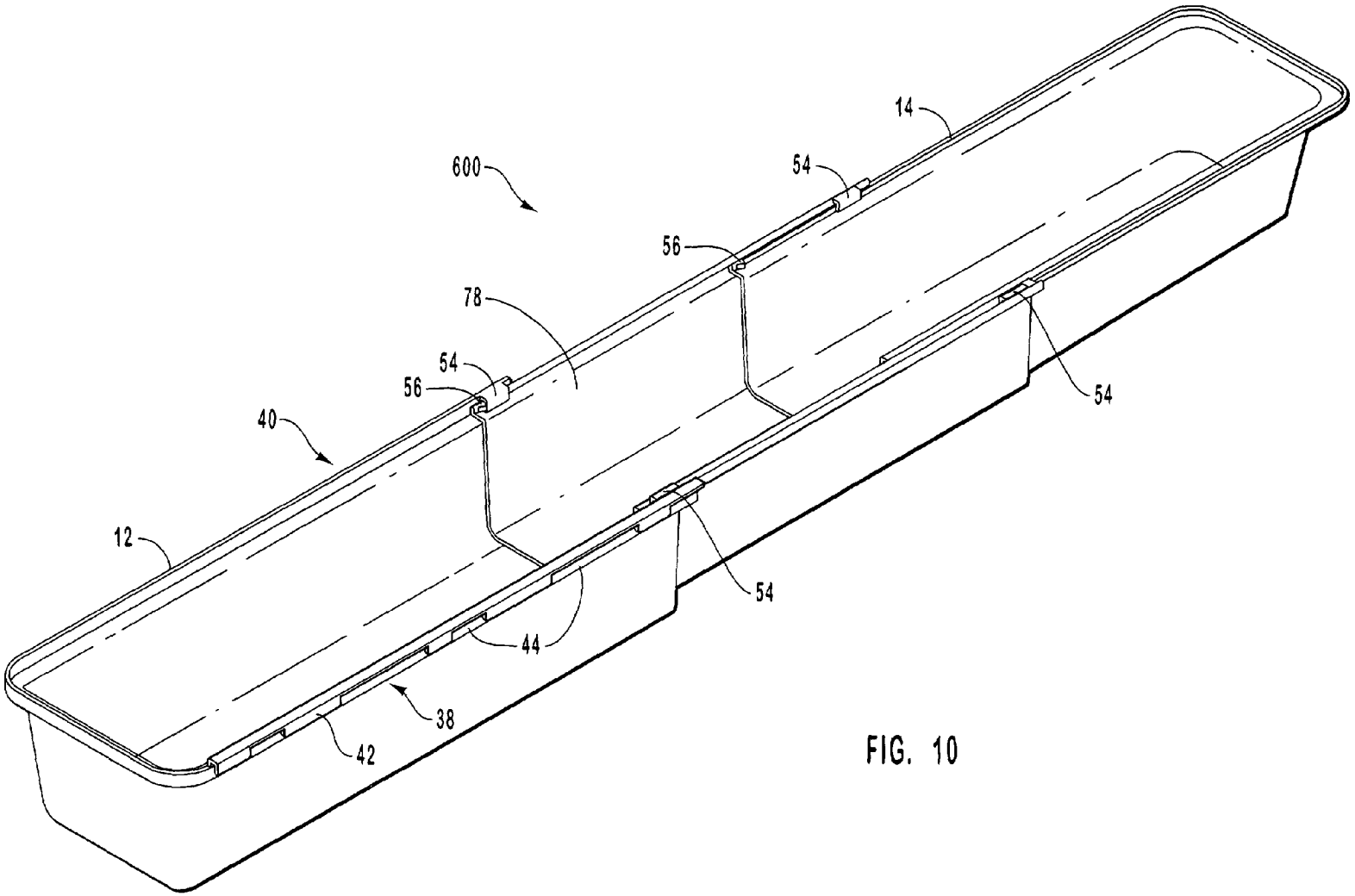
FIG. 10 illustrates a perspective view of another embodiment of the container of the present invention depicting the container having more than one sliding portions.

In one embodiment, shown in FIGS. 1 and 2, first portion 12 and second portion 14 form a single compartment. In another embodiment, as shown in FIG. 9, container 500 has a first portion 12 and/or second portion 14 having additional walls 36 to form multiple compartments when first portion 12 and second portion 14 are slidably coupled together. Furthermore, in another embodiment, shown in FIG. 10, container 600 may have additional portions 78 slidably coupled with first portion 12 and second portion 14. It will be appreciated that use of additional portions 78 will increase the length in which container 10 is able to extend.

Suitable materials for forming first portion 12 and second portion 14 are metals, such as aluminum and stainless steel, or plastics.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A container comprising:

a first portion having a first volume formed by a bottom surface, a first and second sidewall, and an end wall;

a second portion having a second volume formed by a bottom surface, a first and second sidewall, and an end wall, the second volume of the second portion overlapping the first volume of the first portion, and the second portion being slidably coupled with the first portion such that the first portion and the second portion are selectively adjustable between a retracted position and an extended position;

a retention portion disposed on the first sidewall of the first portion; and a receiving portion disposed on the second sidewall of the first portion, the receiving portion on the second sidewall of the first portion being structured differently than the retention portion on the first sidewall of the first portion, the receiving portion being configured to selectively engage with a retention portion of an adjacent container placed next to the container defined by the first portion and the second portion, the retention portion of the adjacent container being substantially identically structured as the retention portion of the container defined by the first portion and the second portion, and the retention portion of the container being configured to selectively engage with a receiving portion of another adjacent container placed next to the container defined by the first portion and the second portion, the receiving portion of the another adjacent container being substantially identically structured as the receiving portion of the container defined by the first portion and the second portion.

2. The container as recited in claim 1, further comprising:

a guide disposed on the first portion or second portion for guiding the first portion and second portion as the first portion and second portion slide in relation to each other between the retracted position and the extended position.

3. The container as recited in claim 1, further comprising:

a stop disposed on the first portion or second portion for preventing the first portion and the second portion from separating when the first portion and second portion are in the extended position.

4. The container as recited in claim 1, wherein the retention portion comprises a flange and the receiving portion comprises a ridge.

5. The container as recited in claim 4, wherein the flange comprises one or more notches formed on a bottom portion thereof.

6. The container as recited in claim 1, wherein the retention portion and the receiving portion are disposed longitudinally to the direction of adjustment of the container.

7. The container as recited in claim 2, further comprising a stop disposed on the first portion or the second portion, the stop configured to engage with the guide to form the adjustable limit between the first and second portions.

8. The container as recited in claim 1, further comprising:

a stop disposed on the second portion; and a groove disposed on the first portion, the stop being configured to engage the groove to prevent the first portion from becoming disengaged from the second portion.

9. The container as recited in claim 1, further comprising a plurality of feet disposed on the bottom surfaces of the first portion and the second portion, the plurality of feet on the first portion and the second portion being varied in height so that the first portion and the second portion are substantially level.

10. The container as recited in claim 1, wherein the first and second portion are slidably engaged such that the first and second portion form a single compartment, the single compartment being selectively adjustable in size.

11. The container as recited in claim 1, wherein the first and second portion are slidably engaged such that the first and second portion form multiple compartments, at least one of the multiple compartments being selectively adjustable in size.

12. A container configured to be selectively coupled to a second container and a third container, the container comprising:

a first portion having a first volume formed by a bottom surface, a first and second sidewall, and an end wall;

a second portion having a second volume formed by a bottom surface, a first and second sidewall, and an end wall, the second volume of the second portion overlapping the first volume of the first portion, and the second portion being slidably coupled to the first portion such that the first portion and the second portion are selectively adjustable between a retracted position and an extended position;

means for guiding the first portion and the second portion as the first portion and second portion slide in relation to each other between the retracted position and the extended position;

means for preventing the first portion and the second portion from separating when the first portion and second portion are in the extended position;

a retention portion disposed on the first sidewall of the first portion, the retention portion configured to selectively engage with a receiving portion of a second container placed next to the container defined by the first portion and the second portion; and a receiving portion disposed on the second sidewall of the first portion, the receiving portion configured to selectively engage with a retention portion of a third container placed next to the container defined by the first portion and the second portion, the retention portion on the first sidewall of the first portion being structured differently than the receiving portion on the second sidewall of the first portion, the receiving portion of the second container being substantially identically structured as the receiving portion on the second sidewall of the first portion, and the retention portion of the third container being substantially identically structured as the retention portion on the first sidewall of the first portion.

13. The container as recited in claim 12, wherein the means for guiding the first portion and the second portion as the first portion and second portion slide in relation to each other between the retracted position and the extended position comprises:

a guide disposed on one of the first portion and second portion and engaging the first portion or second portion without the guide.

14. The container as recited in claim 13, wherein the guide is an L-shaped guide.

15. The container as recited in claim 12, wherein the means for guiding the first portion and the second portion as the first portion and second portion slide in relation to each other between the retracted position and the extended position comprises:

a recess formed in one of the first or second sidewalls of the first portion; and a ledge disposed on the peripheral edge of one of the first or second sidewalls of the second portion, the ledge of the second portion being disposed in the recess of the first portion.

16. The container as recited in claim 12, wherein the means for preventing the first portion and the second portion from separating when the first portion and second portion are in the extended position comprises:

a stop disposed on one of the first portion or second portion, the stop configured to engage the means for guiding the first portion and the second portion as the first portion and second portion slide in relation to each other between the retracted position and the extended position.

17. The container as recited in claim 12, wherein the means for preventing the first portion and the second portion from separating when the first portion and second portion are in the extended position comprises:

a stop disposed on one of the first portion or second portion; and a groove disposed on the first portion or second portion that does not have the stop, the stop being configured to engage the groove.

18. The container as recited in claim 12, wherein the retention portion comprises a flange; and the receiving portion comprises a ridge.

19. The container as recited in claim 18, wherein the flange further comprises one or more notches disposed on a bottom portion thereof.

20. A system of couplable containers, each of the containers having a retention portion and a receiving portion, the system of couplable containers including at least one selectively adjustable container, the selectively adjustable container comprising:

a first portion having a first volume formed by a bottom surface, a first and second sidewall, and an end wall;

a second portion having a second volume formed by a bottom surface, a first and second sidewall, and an end wall, the second volume of the second portion overlapping the first volume of the first portion, and the second portion being slidably coupled to the first portion such that the first portion and second portion are selectively adjustable between a retracted position and an extended position;

a retention portion located on the first sidewall of the first portion, the retention portion configured to selectively engage with a receiving portion of a second container placed next to the container defined by the first portion and the second portion; and a receiving portion located on the second sidewall of the first portion, the receiving portion being configured to selectively engage with a retention portion of a third container placed next to the container defined by the first portion and the second portion, the retention portion on the first sidewall of the first portion being structured differently than the receiving portion on the second sidewall of the first portion, the receiving portion of the second container being substantially identically structured as the receiving portion on the second sidewall of the first portion, and the retention portion of the third container being substantially identically structured as the retention portion on the first sidewall of the first portion.

21. The container as recited in claim 20, wherein the retention portion comprises a flange.

22. The container as recited in claim 20, wherein the retention portion comprises an L-shaped flange having one or more notches formed in a bottom portion thereof.

23. The container as recited in claim 20, wherein the receiving portion comprises a ridge.

24. The container as recited in claim 20, wherein the retention portion comprises a flange extending outwardly therefrom and a series of pins depending downwardly from the flange, and wherein the receiving portion comprises a flange extending outwardly therefrom and having a series of holes configured to receive the pins.

25. The container as recited in claim 20, further comprising:

a guide disposed on the first portion or second portion for guiding the first portion and second portion as the first portion and second portion slide in relation to each other between the retracted position and the extended position.

26. The container as recited in claim 20, further comprising:

a stop disposed on the first portion or second portion for preventing the first portion and the second portion from separating when the first portion and second portion are in the extended position.

27. A container comprising:

a first portion having a first volume formed by a bottom surface, a first and second sidewall, and an end wall;

a second portion having a second volume formed by a bottom surface, a first and second sidewall, and an end wall, the second volume of the second portion overlapping the first volume of the first portion, and the first portion and the second portion being slidably coupled such that the first portion and the second portion are selectively adjustable between a retracted position and an extended position;

a flange located on the first sidewall of the first portion, the flange configured to selectively engage with a ridge on a second container placed next to the container defined by the first portion and the second portion;

a ridge located on the second sidewall of the first portion, the ridge configured to selectively engage with a flange on a third container placed next to the container defined by the first portion and the second portion, the flange on the first sidewall of the first portion being structured differently than the ridge on the second sidewall of the first portion, the ridge of the second container being substantially identically structured as the ridge on the second sidewall of the first portion, and the flange of the third container being substantially identically structured as the flange on the first sidewall of the first portion;

a guide disposed on the first portion or second portion, the guide configured to engage the opposing first or second portion; and a stop disposed on the first portion or second portion, the stop configured to prevent the first and second portions from separating when the first and second portions are in the extended position.

28. The container as recited in claim 27, wherein the flange is an L-shaped flange having notches formed on a bottom portion thereof.

29. The container as recited in claim 27, wherein the stop is configured to engage the guide.

30. The container as recited in claim 27, further comprising a groove disposed on the first or second portion, the stop being configured to engage the groove to prevent the first and second portions from separating when the first and second portions are in the extended position.

31. The container as recited in claim 27, wherein the guide comprises a recess formed in one of the first or second sidewalls of the first portion, and further comprising a ledge disposed on the peripheral edge of one of the first or second sidewalls of the second portion, the ledge of the second portion being disposed in the recess of the first portion.

* * * * *